US008201969B2

(12) United States Patent
Liu et al.

(10) Patent No.: US 8,201,969 B2
(45) Date of Patent: Jun. 19, 2012

(54) LED ILLUMINATOR WITH HEAT DISSIPATION STRUCTURE

(75) Inventors: Jun Liu, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 849 days.

(21) Appl. No.: 12/252,374

(22) Filed: Oct. 16, 2008

(65) Prior Publication Data

US 2010/0097796 A1 Apr. 22, 2010

(51) Int. Cl.
*F21S 4/00* (2006.01)
*F21V 29/00* (2006.01)

(52) U.S. Cl. ..... 362/249.02; 362/249.11; 362/294; 362/373

(58) Field of Classification Search ..... 362/545, 362/547, 249.02, 249.06, 249.11, 294, 373
See application file for complete search history.

(56) References Cited

U.S. PATENT DOCUMENTS

| | | | | |
|---|---|---|---|---|
| 5,567,036 | A * | 10/1996 | Theobald et al. | 362/485 |
| 6,244,728 | B1 * | 6/2001 | Cote et al. | 362/249.06 |
| 6,525,668 | B1 * | 2/2003 | Petrick | 340/815.45 |
| 7,329,030 | B1 * | 2/2008 | Wang | 362/373 |
| 7,513,653 | B1 * | 4/2009 | Liu et al. | 362/294 |
| 7,547,922 | B2 * | 6/2009 | Tan et al. | 257/88 |
| 7,637,636 | B2 * | 12/2009 | Zheng et al. | 362/294 |
| 7,637,637 | B2 * | 12/2009 | Liu et al. | 362/294 |
| 7,665,864 | B2 * | 2/2010 | Zheng et al. | 362/249.11 |
| 7,726,845 | B2 * | 6/2010 | Zheng et al. | 362/294 |
| 7,789,528 | B2 * | 9/2010 | Mo et al. | 362/249.02 |
| 2004/0062055 | A1 | 4/2004 | Rozenberg et al. | |
| 2008/0089071 | A1 | 4/2008 | Wang | |
| 2009/0185374 | A1 * | 7/2009 | Wu et al. | 362/249.06 |
| 2009/0323342 | A1 * | 12/2009 | Liu | 362/249.02 |

* cited by examiner

*Primary Examiner* — Ismael Negron
(74) *Attorney, Agent, or Firm* — Altis Law Group, Inc.

(57) ABSTRACT

An LED illuminator includes an illuminator base and at least two LED lamp units inclinedly disposed on a surface of the illuminator base. Each of the LED lamp units includes a heat dissipation structure and LEDs oriented downwardly and outwardly. A U-shaped fixing element is secured to a center of the illuminator base. The LED lamp units are connected with sidewalls of the fixing element.

13 Claims, 3 Drawing Sheets

LED ILLUMINATOR WITH HEAT DISSIPATION STRUCTURE

BACKGROUND OF THE INVENTION

1. Field of the Invention

The present invention relates to light emitting diode (LED) illuminators and, particularly, to an LED illuminator with a heat dissipation structure.

2. Description of Related Art

With the continuing development of scientific technology, light emitting diodes have been widely used in the illumination field due to their high brightness, long life-span, and wide color gamut.

An LED illuminator includes a number of LEDs, and most of the LEDs are driven at the same time, which results in a quick rise in temperature of the LED illuminator. Generally, the LED illuminator does not have a heat dissipation device with good heat dissipating efficiency, and operation of the LED in the illuminator may have a problem of instability because of the rapid accumulation of heat. Consequently, the light emitted from the LED often flickers, which degrades a quality of the LED illuminator. In addition, the LED illuminator is used in a high temperature state for a long time and the life time thereof is consequently shortened.

What is needed, therefore, is an LED illuminator with a heat dissipation structure which can overcome the above-described problems.

SUMMARY OF THE INVENTION

An exemplary embodiment of an LED illuminator includes an illuminator base and at least two LED lamp units disposed on a surface of the illuminator base. Each of the LED lamp units includes a heat dissipation structure. The LED lamp units are inclinedly mounted on the illuminator base, with LEDs oriented downwardly and outwardly so that the LED illumination can have a large illumination range. A U-shaped fixing element is secured to a center of the illuminator base. Each LED lamp unit includes a resilient securing part forming a clamping section clamping a sidewall of the fixing element therein.

Advantages and novel features will become more apparent from the following detailed description when taken in conjunction with the accompanying drawings.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION OF THE INVENTION

An embodiment will now be described in detail below and with reference to the drawings.

Figure 1:
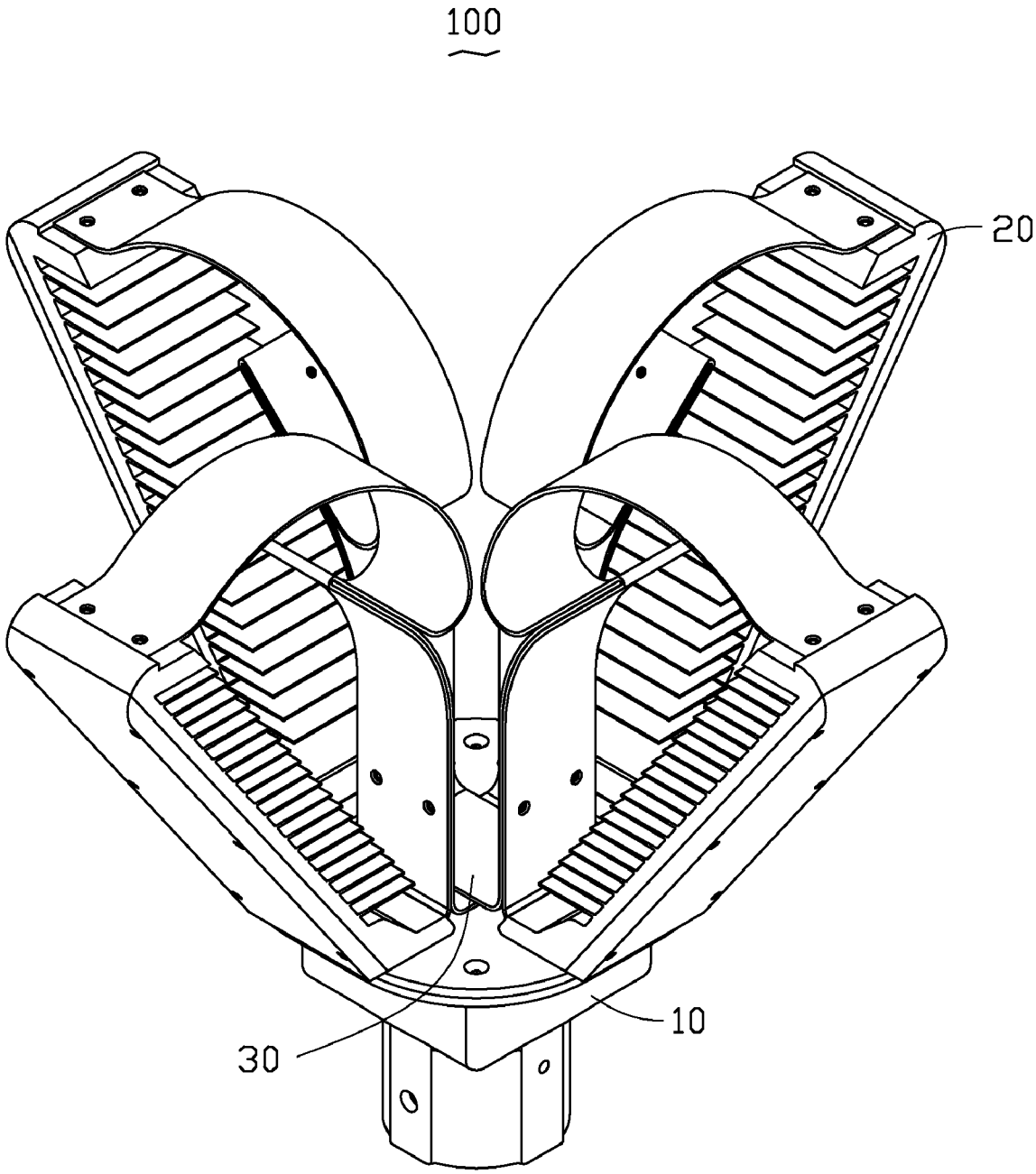
FIG. 1 is an assembled view of an LED illuminator in accordance with an exemplary embodiment.
Figure 2:
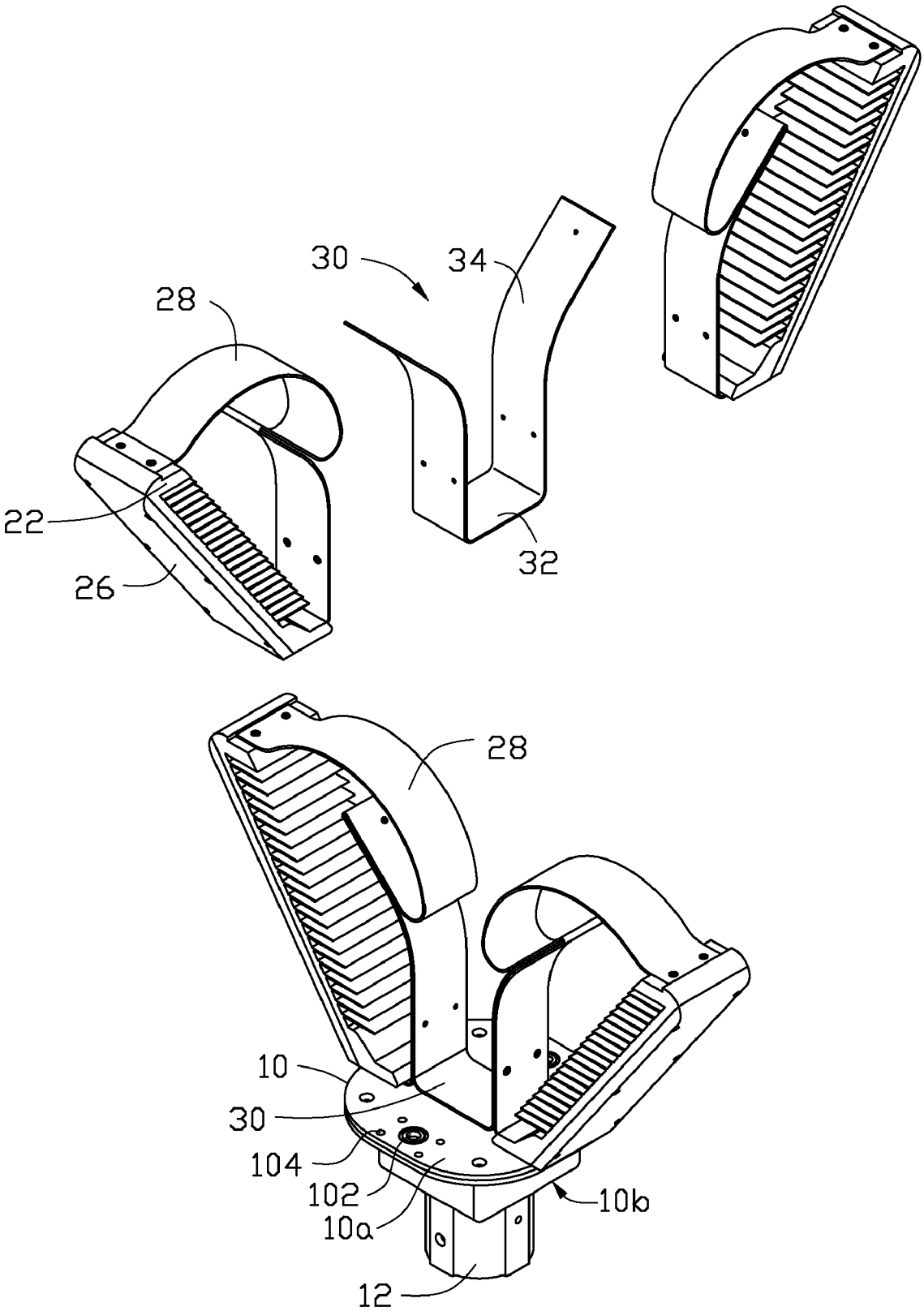
FIG. 2 is an isometric, exploded view of the LED illuminator of FIG. 1.

Referring to FIG. 1 and FIG. 2, an exemplary embodiment of an LED illuminator 100 includes an illuminator base 10, an LED lamp module 20 disposed on the illuminator base 10 and two fixing elements 30 mounted on the LED lamp module 20. The illuminator base 10 is configured (i.e., structured and arranged) for supporting the LED lamp module 20 thereon. The LED lamp module 20 includes at least two LED lamp units 21 radially disposed on a surface of the illuminator base 10. In the present embodiment, the LED lamp module 20 includes four LED lamp units 21 radially and uniformly disposed on the surface of the illuminator base 10. For example, the illuminator base 10 is a rectangular block, and has a first surface 10*a* and a second surface 10*b* opposing to the first surface 10*a*. An imaginary circle is defined on a center of the first surface 10*a*. The four LED lamp units 21 are uniformly disposed on the imaginary circle of the first surface 10*a*. That is, the imaginary circle is divided into four equal arcs by the four LED lamp units 21.

The four LED lamp units 21 can be fixedly or movably disposed on the first surface 10*a* of the illuminator base 10 by general mechanical manners. In the present embodiment, the LED lamp units 21 are fixedly disposed on the first surface 10*a* by bolts (not shown). In detail, four first through holes 102 are defined in the first surface 10*a* of the illuminator base 10 at the imaginary circle therof. The four first through holes 102 divide the imaginary circle into four equal arcs. Four first positioning holes 104 are uniformly defined around each of the first through holes 102. Each of the first through holes 102 corresponds to an LED lamp unit 21, and allows an electrical circuit passing therethrough to electrically connect to the corresponding LED lamp unit 21. The first positioning holes 104 are configured for mating with bolts to fasten the LED lamp unit 21 on the first surface 10*a* of the illuminator base 10.

It is to be understood that structures, locations and number of the first through holes 102 and the first positioning holes 104 could potentially be varied, so long as the LED lamp units 21 can be radially secured on the illuminator base 10. In addition, the LED lamp units 21 can be movably or pivotably disposed on the first surface 10*a* of the illuminator base 10; thus, a light direction of each LED lamp unit 21 and arrangements of the LED lamp units 21 can be adjusted accordingly.

A columnar rod 12 protrudes downwardly from a central portion of the second surface 10*b*, and perpendicular to the second surface 10*b*. The columnar rod 12 is configured for connecting the illuminator base 10 with a lamp pole (not shown).

Figure 3:
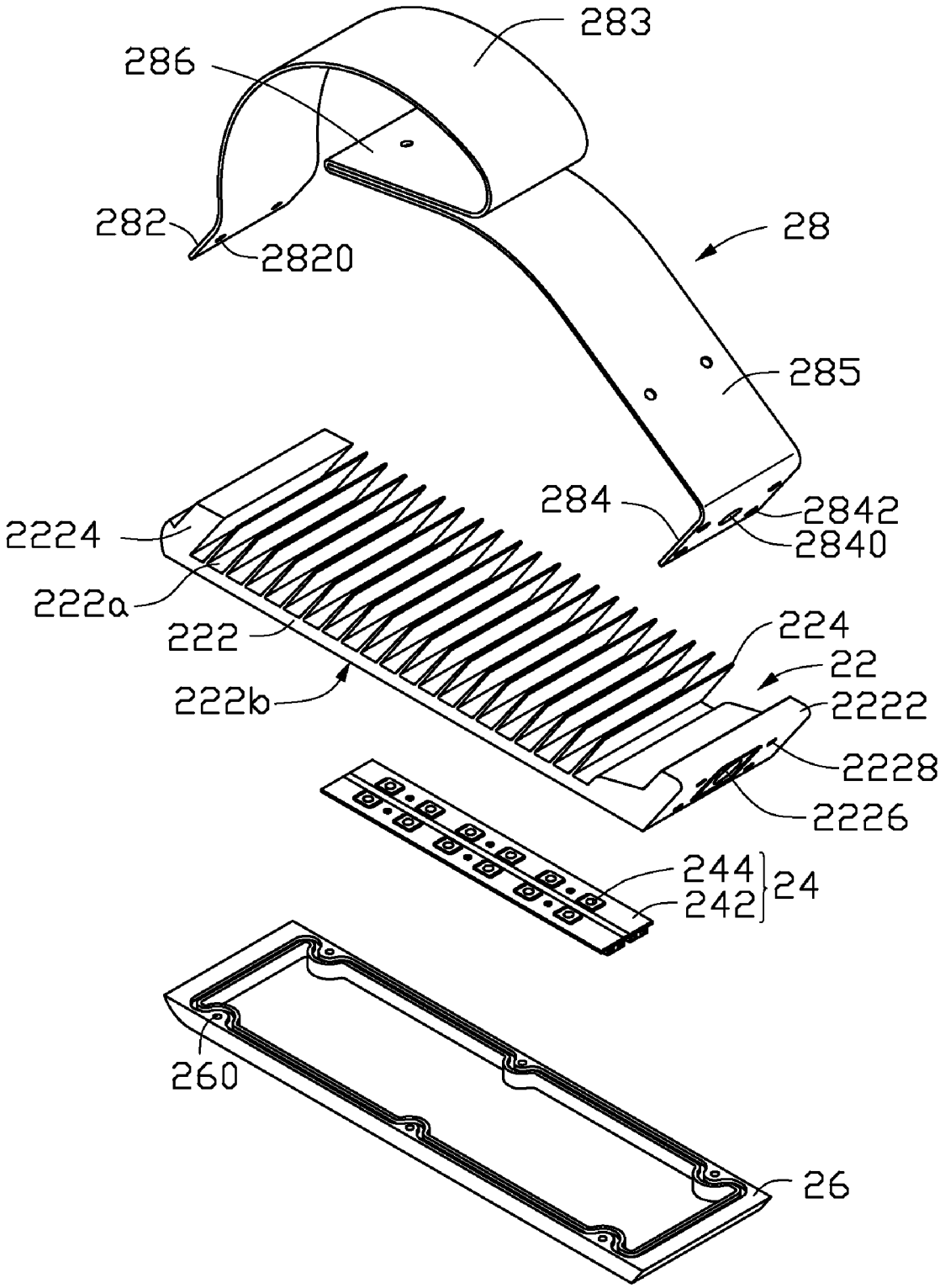
FIG. 3 is an isometric, exploded view of an LED lamp unit of an LED lamp module of the LED illuminator of FIG. 2.

Referring to FIG. 3, the LED lamp unit 21 includes a heat dissipation structure 22, an LED module 24, an envelope 26, and a securing part 28. The heat dissipation structure 22 is an integral structure and made of a heat conducting material such as aluminum, copper, and the like. The heat dissipation structure 22 includes a rectangular base plate 222 and a number of fins 224. The base plate 222 defines an internal side surface 222*a* and an external side surface 222*b* opposing the internal side surface 222*a*. A bottom plate 2222 and a top plate 2224 respectively extend from two opposite ends of the base plate 222 and locate at the internal side surface 222*a*. Each of the bottom plate 2222 and the top plate 2224 is angled with respect to the internal side surface 222*a* of the base plate 222. When the heat dissipation structure 22 is assembled to the first surface 10*a* of the illuminator base 10, the angle between the bottom plate 2222 and the internal side surface 222*a* enables the heat dissipation structure 22 to be oblique to or angled with respect to the first surface 10*a*. Thus, the LED lamp unit 21 including the heat dissipation structure 22 can be obliquely disposed on the first surface 10*a*. In this fashion, the four LED lamp units 21 are radially disposed on the first surface 10*a*.

A second through hole 2226 corresponding to a first through hole 102 is defined in the bottom plate 2222. Four second positioning holes 2228 surround the second through hole 2226. Each of the second positioning holes 2228 corresponds to a first positioning hole 104, and mates with the bolt passing through the corresponding first positioning hole 104.

The fins 224 obliquely extend from the internal side surface 222*a* and evenly spaced from each other. An angle between each of the fins 224 and the internal side surface 222*a* of the base plate 222 is identical. The bottom plate 2222, the top plate 2224, and the fins 224 are located at the internal side surface 222*a* of the base plate 222 and parallel with one another.

The LED module 24 is attached to the external side surface 222*b* of the base plate 222, and includes a printed circuit board 242 and a number of LEDs 244 mounted on the printed circuit board 242. In the present embodiment, the LED module 24 includes twelve LEDs 244 arranged uniformly in two rows on the printed circuit board 242. Each of the two rows has six LEDs 244 arranged therein. The printed circuit board 242 can be attached to the external side surface 222*b* of the base plate 222 using an adhesive or a bolt connection. In the present embodiment, the printed circuit board 242 is attached to the external side surface 222*b* using an adhesive.

The envelope 26 is made of a transparent material such as organic glass, resin, and so on. The envelope 26 has a suitable structure capable of engaging with the external side surface 222*b* of the base plate 222. In the present embodiment, the envelope 26 is a rectangular plate. Six screw holes 260 are defined in positions near an edge of the envelope 26, and mate with six bolts, thereby binding the envelope 26 to the external side surface 222*b* of the base plate 222. In detail, the envelope 26 has a first edge and a second edge opposing to the first edge. Three screw holes 260 are defined in the first edge of the envelope 26, other three screw holes 260 are defined in the second edge. It is to be understood that shapes, positions and number of the screw holes 260 could potentially be varied, so long as the envelope 26 can be secured on the external side surface 222*b* of the base plate 2220.

The securing part 28 is an integral structure and made of a metal material. Preferably, the securing part 28 is formed by bending a metal sheet. The securing part 28 has a certain elasticity for credibly engaging with one of the fixing elements 30. The securing part 28 includes an upper securing section 282, an arcuate section 283, a lower securing section 284, a vertical section 285 and a clamping section 286. In the present embodiment, all of these sections 282, 283, 284, 285, 286 are metal sheet structures. The upper securing section 282 is fixed on the top plate 2224 of the heat dissipation structure 22. The lower securing section 284 is fixed on the bottom plate 2222 of the heat dissipation structure 22. The arcuate section 283 connects the upper securing section 282 to one end of the clamping section 286. The vertical section 285 connects the lower securing section 284 to another end of the clamping section 286. The clamping section 286 is a folded structure and located at a middle portion of the securing part 28. Specifically, the clamping section 28 includes two rectangular sheets, and an end of one rectangular sheet connects with a corresponding end of another rectangular sheet. Thus, the two sheets operatively define a semi-closed clamping space therebetween. An opening direction of the semi-closed clamping space is opposite/back to the heat dissipation structure 22. That is, the clamping section 286 folds towards the heat dissipation structure 22.

Two mounting holes 2820 are defined in the upper securing section 282 to mate with two bolts. As a result, the upper securing section 282 of the securing part 28 is fixed on the top plate 2224 of the heat dissipation structure 22. The vertical section 285 is perpendicularly connected to the lower securing section 284. A third through hole 2840 corresponding the first and second through holes 102, 2226 is defined in a central portion of the lower securing section 284. Four third positioning holes 2842 are defined in the lower securing section 284 and surround the third through hole 2840. Each of the third positioning holes 2842 corresponds to a first positioning hole 104 and a second positioning hole 2228. Thus, four bolts pass through four first, second and third positioning holes 104, 2228, 2842 respectively to fasten the lower securing section 284 of the securing part 28 and the bottom plate 2222 of the heat dissipation structure 22 on the first surface 10*a* of the illuminator base 10. As a result, the LED lamp unit 21 including the securing part 28 and the heat dissipation structure 22 is secured on the first surface 10*a* of the illuminator base 10.

Referring back to FIG. 2, in order to ensure the LED lamp units 21 being reliably secured on the illuminator base 10, the fixing elements 30 is provided to cooperate with the securing parts 28. That is, the fixing elements 30 are configured (i.e., structured and arranged) for mating with the securing parts 28 of the LED lamp units 21 to assemble the LED lamp units 21 to the first surface 10*a* of the illuminator base 10. In the present embodiment, the two fixing elements 30 are generally U-shaped.

Specifically, each U-shaped fixing element 30 includes a rectangular flat plate 32, two sidewalls 34 upwardly extend from two opposite ends of the flat plate 32. The two sidewalls 34 are located at a same side (e.g., an upper side) of the flat plate 32. Each of the sidewalls 34 includes a bottom section and a top section connected to the bottom section. Two bottom sections of the two sidewalls 34 are perpendicularly connected to the opposite ends of the flat plate 32. Two top sections of the sidewalls 34 outwardly extend from the bottom sections, and are symmetrically oblique to the flat plate 32 with respect to a middle line between the two opposite ends of the flat plate 32. That is, a distance between two top sections is larger than a distance between the two bottom sections. Also, in other words, the top sections of the two sidewalls 34 of the two fixing elements 30 are radially arranged with respect to the first surface 10*a* of the illuminator base 10.

The two fixing elements 30 are arranged in a crosswise manner, and each fixing element 30 is engaged with two LED lamp units 21. Specifically, one flat plate 32 is mounted on the first surface 10*a*, and another flat plate 32 is disposed on the one flat plate 32 in the crosswise manner. Each of the sidewalls 34 of the fixing elements 30 is engaged with a corresponding clamping section 286 of each LED lamp unit 21. Thus, the four LED lamp units 21 are engaged with two fixing elements 30, and radially arranged on the first surface 10*a* of the illuminator base 10. The fixing elements 30, the securing part 28, and the illuminator base 10 can be fixed together using a bolt or a soldering manner. In the present embodiment, the fixing elements 30, the securing part 28 and the illuminator base 10 are fixed by bolts.

It is understood that structures and number of the securing parts 28 and the fixing elements 30 could potentially be varied, so long as the securing parts 28 are capable of mating with the fixing elements 30, so as to assemble/modularize a number of LED lamp units 21 to be the LED lamp module 20 and fix the LED lamp module 20 on the illuminator base 10.

In assembly, first of all, the two fixing elements 30 are disposed on a central portion of the first surface 10*a* of the illuminator base 10 in the crosswise manner. Second, the four securing parts 28 are engaged with the four sidewalls 34 of the fixing elements 30. In detail, the top section of each sidewall 34 is inserted into the clamping section 286 of each securing part 28, and the bottom section of each sidewall 34 is bound to the vertical section 285 of each securing part 28. Third, the LED module 24 is attached to a corresponding heat dissipation structure 22. Fourth, the heat dissipation structure 22 of each LED lamp unit 21 is assembled with a corresponding securing part 28. In detail, two bolts respectively pass through the two mounting holes 2820 defined in the upper securing section 282 of the securing part 28, and screwed to the top plate 2224 of the heat dissipation structure 22. Four bolts respectively pass through four first positioning holes 104 of the illuminator base 10, four third positioning holes 2842 of the securing parts 28 and four second positioning holes 2228 of the heat dissipation structures 22 to fix the LED lamp units 21 on the first surface 10*a* of the illuminator base 10.

Regarding the LED illuminator 100 of the above-described embodiment, the LED lamp module 20 of the LED illuminator 100 includes at least two LED lamp units 21 radially and uniformly arranged on the first surface 10*a* of the illuminator base 10, and each of the LED lamp units 21 has an independent heat dissipation structure 22 integrated therewith. Such structure enables the LED illuminator 100 having the following advantageous. Firstly, due to having the independent heat dissipation structure 22, the heat generated by each of the LED lamp units 21 can be removed directly and rapidly. Any change of the number of the LED lamp units 21 can not affect the heat dissipation performance of the LED illuminator 100. For example, when the LED lamp module 20 has five or more LED lamp units 21, although the heat generated of the whole LED lamp module 20 increases, the heat generated by each LED lamp unit 21 can also be removed directly and rapidly. Therefore, a whole heat dissipation performance of the LED lamp module 20 can not be affected. That is, the heat dissipation performance of the LED illuminator 100 can not be degraded.

Secondly, the LED lamp units 21 are radially disposed on the illuminator base 10 to obtain a three-dimensional light emitting surface. The three-dimensional light emitting surface enables the LED illuminator 100 to generate a broad and uniform light illumination.

Thirdly, because the LED lamp units 21 can be movably disposed on the illuminator base 10, light emitting directions of the LED lamp units 21 can be adjusted according to a practical requirement. Thus, the three-dimensional light emitting surface of the LED illuminator 100 can be designed according to a practical requirement. Therefore, the LED illuminator 100 can be widely used to various illumination devices.

Finally, the LED lamp units 21 are secured on the illuminator base 10 through the cooperation between the securing parts 28 and the fixing elements 30. Such cooperation relationships between the securing parts 28 and the fixing elements 30 can firmly and reliably fix the LED lamp units 21 on the illuminator base 10.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An LED illuminator comprising:

an illuminator base having a surface;

four LED lamp units radially disposed on the surface of the illuminator base, each of the four LED lamp units comprising a heat dissipation structure, the four LED lamp units being inclinedly mounted on the surface of the illuminator base with LEDs of each of the four LED lamp units being oriented downwardly and outwardly;

wherein the heat dissipation structures of the four LED lamp units are radially disposed on the surface of the illuminator base;

wherein each heat dissipation structure comprises a base plate and a plurality of fins, the base plate defines an internal side surface and an external side surface opposing the internal side surface, and the fins are formed on the internal side surface;

wherein a bottom plate and a top plate obliquely protrude from two opposite ends of the internal side surface;

wherein each of the four LED lamp units further comprises a securing part having an upper securing section engaged with the top plate and a lower securing section engaged with the bottom plate; and wherein two U-shaped fixing element mating with the securing parts secure the each of the four LED lamp units on the surface of the illuminator base.

2. The LED illuminator as claimed in claim 1, wherein an imaginary circle is defined on a central portion of the illuminator base, the heat dissipation structures are disposed on the imaginary circle and equally divide the imaginary circle.

3. The LED illuminator as claimed in claim 1, wherein the LEDs of each of the four LED lamp units are attached to the external side surface.

4. The LED illuminator as claimed in claim 3, wherein each of the four LED lamp units additionally comprises an envelope mounted on the external side surface to cover the LEDs.

5. The LED illuminator as claimed in claim 1, wherein each of the U-shaped fixing elements comprises a flat plate disposed on the surface of the illuminator base, and two sidewalls upwardly extending from two opposite ends of the flat plate; each of the securing parts comprises a clamping section for mating with a corresponding sidewall of each of the U-shaped fixing elements.

6. The LED illuminator as claimed in claim 5, wherein the securing part further comprises an arcuate section connecting the upper securing section to one end of the clamping section, and a vertical section connecting the lower securing section to another end of the clamping section.

7. The LED illuminator as claimed in claim 5, wherein each sidewall of the U-shaped fixing element comprises a bottom section perpendicularly connected to the flat plate, and a top section obliquely connected to the bottom section.

8. The LED illuminator as claimed in claim 7, wherein a distance between two top sections is larger than a distance between the two bottom sections.

9. An LED illuminator comprising:

an illuminator base having a surface; and at least two LED lamp units disposed on the surface of the illuminator base, each of the at least two LED lamp units comprising a heat dissipation structure, the at least two LED lamp units being inclinedly mounted on the surface of the illuminator base with LEDs of each of the at least two LED lamp units being oriented downwardly and outwardly;

wherein the heat dissipation structures of the at least two LED lamp units are radially disposed on the surface of the illuminator base;

wherein the heat dissipation structure comprises a base plate and a plurality of fins, the base plate defines an internal side surface and an external side surface opposing the internal side surface, and the fins are formed on the internal side surface;

wherein the LEDs of each of the at least two LED lamp units are attached to the external side surface; and wherein each of the at least two LED lamp units additionally comprises an envelope mounted on the external side surface to cover the LEDs.

10. An LED illuminator comprising:

an illuminator base having a surface;

a plurality of heat dissipation structures, wherein each of the heat dissipation structures comprises a base plate, a bottom plate and a top plate, the bottom plate and the top plate obliquely protrude from top and bottom ends of the base plate, the bottom plate is secured on the surface of the illuminator base;

a securing part having an upper securing section engaged with the top plate and a lower securing section engaged with the bottom plate;

a U-shaped fixing element mating with the securing part to secure the heat dissipation structures on the surface of the illuminator base; and a plurality of LEDs being disposed on the base plate of each of the heat dissipation structures.

11. The LED illuminator as claimed in claim 10, wherein an imaginary circle is defined on the surface of the illuminator base, the base plates of the heat dissipation structures are tilted from the imaginary circle along an outward direction.

12. The LED illuminator as claimed in claim 11, wherein each of the base plates of the heat dissipation structures has an internal side surface facing towards the imaginary circle and an external side surface facing away from the imaginary circle, the LEDs are disposed on the external side surface.

13. The LED illuminator as claimed in claim 11, wherein a plurality of fins are formed on the internal side surface of each of the base plates.

* * * * *